US009308543B1

(12) United States Patent
Smith

(10) Patent No.: US 9,308,543 B1
(45) Date of Patent: Apr. 12, 2016

(54) ATTACHMENT FOR A SPRAYING DEVICE FOR USE IN SMALL PLACES WITH EVACUATION OF PARTICULATES

(71) Applicant: William C. Smith, Upland, CA (US)

(72) Inventor: William C. Smith, Upland, CA (US)

( * ) Notice: Subject to any disclaimer, the term of this patent is extended or adjusted under 35 U.S.C. 154(b) by 0 days.

(21) Appl. No.: 14/519,419

(22) Filed: Oct. 21, 2014

(51) Int. Cl.
*B05B 15/04* (2006.01)
*B05B 1/02* (2006.01)
*B05B 1/28* (2006.01)

(52) U.S. Cl.
CPC ..... *B05B 15/0493* (2013.01); *B05B 1/02* (2013.01); *B05B 15/0406* (2013.01); *B05B 1/28* (2013.01)

(58) Field of Classification Search
CPC ..... B05B 1/28; B05B 1/0493; B05B 1/02; B05B 7/1454; B05B 15/0406; B05B 15/0412; B05B 15/0425; B05B 15/0431; B08B 2203/0229; B08B 5/04; B05C 11/1039; B05C 17/0052
USPC ..... 239/119, 120, 124, 125, 195, 525–532, 239/587.1, 588, 104, 121, 288, 288.3, 288.5
See application file for complete search history.

(56) References Cited

U.S. PATENT DOCUMENTS

| | | | | | |
|---|---|---|---|---|---|
| 4,159,554 | A * | 7/1979 | Knight et al. | 15/321 | |
| 5,263,646 | A * | 11/1993 | McCauley | 239/154 | |
| 5,271,564 | A * | 12/1993 | Smith | B05B 7/0081 | 239/290 |
| 5,971,298 | A | 10/1999 | Millan et al. | | |
| 7,550,022 | B2 | 6/2009 | Smith | | |
| 7,837,130 | B1 * | 11/2010 | Lowery | 239/120 | |
| 2004/0149836 | A1 * | 8/2004 | Herhold | 239/288 | |
| 2007/0235563 | A1 * | 10/2007 | Woods | 239/456 | |
| 2007/0295210 | A1 * | 12/2007 | Smith | 95/273 | |

* cited by examiner

*Primary Examiner* — Len Tran
*Assistant Examiner* — Cody Lieuwen
(74) *Attorney, Agent, or Firm* — Thomas Hamill, Jr.; Robert M. Schwartz

(57) ABSTRACT

An attachment for a spraying device which permits spraying to be performed in small spaces and has both bendable and retractable features is provided. An inverted L-shaped portion has a top side and a bottom side. The bottom side is connected to a vacuum hose. The top side is attached to a bendable top hose which includes an internal bendable coaxial tubing which terminates at a nozzle. A removable support engages the nozzle at the end of the top hose. The rear of the coaxial tubing includes an attachment to the spraying device. The top hose and support permit the spraying attachment to spray hard to reach areas. The nozzle support is removable, permitting the top hose to be retracted about the coaxial tubing, freeing the nozzle to access even harder to reach areas. The attachment can evacuate any spray particulates which do not affix to the workpiece.

4 Claims, 8 Drawing Sheets

ATTACHMENT FOR A SPRAYING DEVICE FOR USE IN SMALL PLACES WITH EVACUATION OF PARTICULATES

BACKGROUND OF THE INVENTION

Many items on a machine or device have elements thereon which are remote and difficult to access. Some of these remote elements have a requirement to be coated by any of a host of materials, including, but not limited to, any and all coatings, fluids, adhesives, paints, anti-corrosive agents, insecticides, herbicides, pesticides, waxes, fungicides and the like. It would be useful to have a spray device with the versatility to reach such remote and difficult to access areas, which would include means to capture overspray and errant particles. Current practice includes flooding the area with spray which is both imprecise and wasteful.

SUMMARY OF THE INVENTION

The invention is an attachment for a spray device which includes an elongated flexible vacuum hose which has an internal coaxial line there-within. The internal coaxial line is also flexible, and attaches to the spray device on the proximal side, and terminates on the distal side with a nozzle. The nozzle resides in a removable spider. A removable spider is simply a removable support element which is adapted to receive the nozzle centrally therein. The removable support element or spider is shown in the figures to have a specific configuration. This configuration may be optimal for some applications, however, the invention is not limited to such a configuration. The use of the word spider or removable support element are interchangeable.

The spider is adapted to center and support the internal coaxial line at the distal side. The removable spider may be taken off of the invention, and the elongated flexible vacuum hose may be retracted back toward the proximal side to permit even deeper penetration into a hard to reach area. The elongated flexible vacuum hose would, when retracted, still generates a sufficient vacuum to remove overspray or errant particles when the elongated flexible vacuum hose is in it's retracted state.

The internal coaxial line is surrounded by the elongated flexible vacuum hose along the entire length of the coaxial line. Near the connection point of the coaxial line to the spray device, the proximal side of the flexible vacuum hose mates with an inverted L-shaped element or elbow. The inverted L-shape element has a connection point co-linear with the internal coaxial line where the spray device would be attached. The long end of the inverted L-shaped element points generally downward and is attached to a vacuum hose. The elongated flexible vacuum hose which surrounds the coaxial line, the inverted L-shaped element or elbow, and the downwardly oriented vacuum hose are all in communication with each other creating a continuous passageway for the evacuation of overspray from the nozzle at the distal end of the internal coaxial line. A pump or other means to create a vacuum is provided further down the passageway to exhaust the overspray to an exit. A filter may be placed intermediate the portion of the downwardly oriented vacuum hose proximal the inverted L-shaped element or elbow and the exit to create an a governmental compliant exhaust.

Other structural elements and additional embodiments of the Invention will be introduced and discussed in the Detailed Description of the Figures.

DETAILED DESCRIPTION OF THE FIGURES

Figure 1:
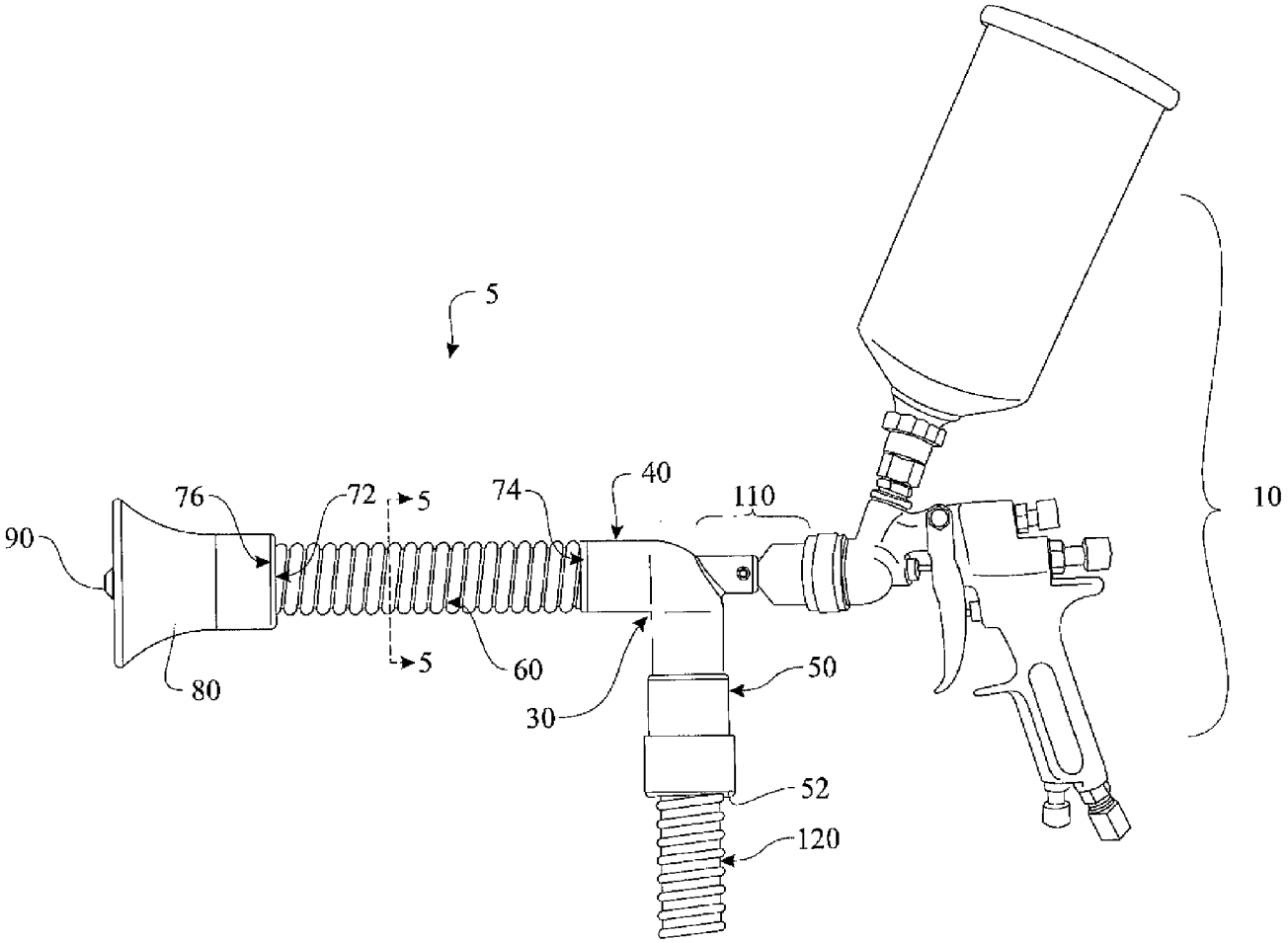
FIG. 1 is a side view of the Attachment for a Spraying Device connected to a spraying device.
Figure 2:
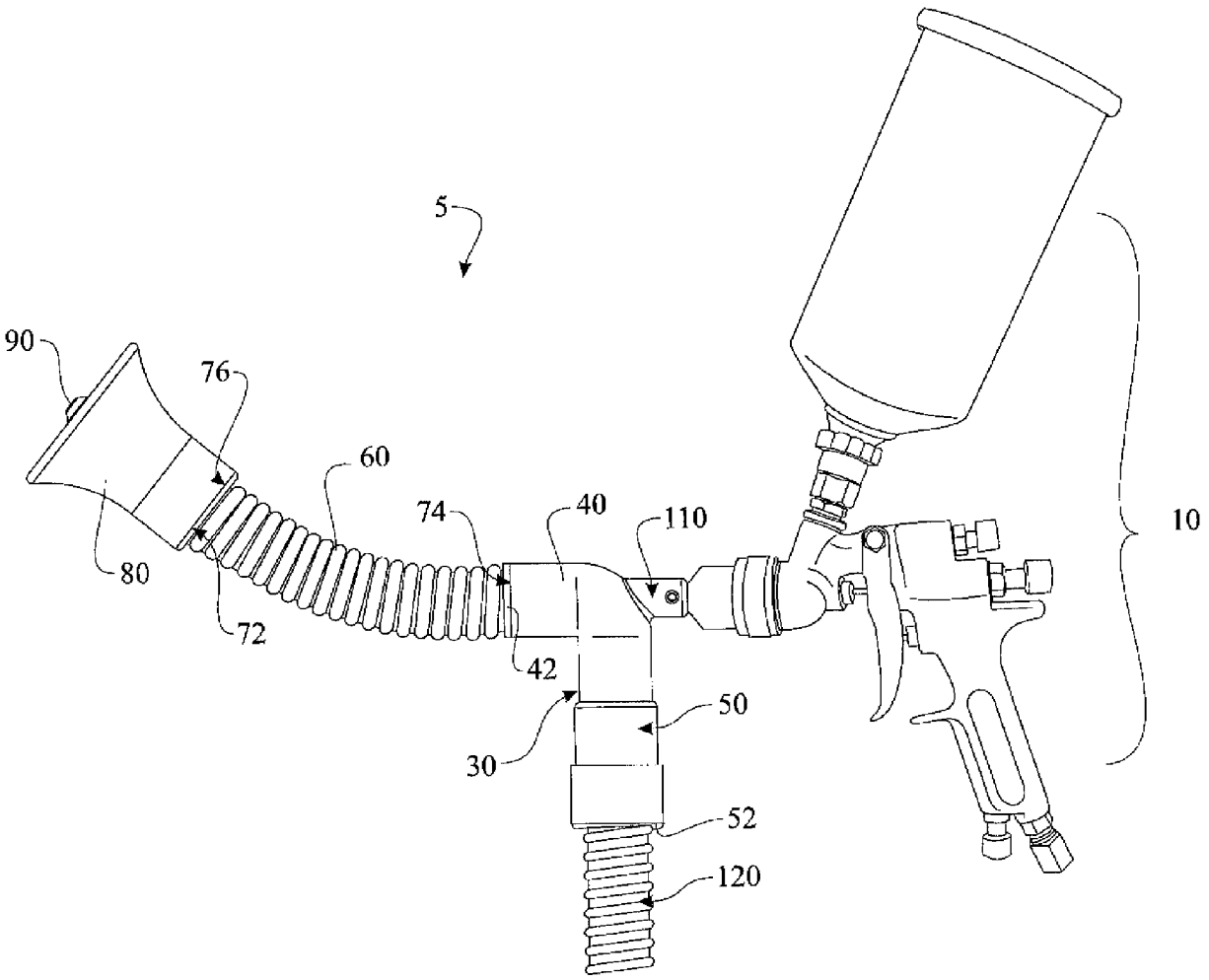
FIG. 2 is a side view of the Attachment for a Spraying Device connected to a spraying device, showing the bendable nature of the front hose of the invention.

Referring now to FIGS. 1 and 2 an attachment 5 (best seen in FIGS. 8 and 9) for a spray device 10 for use in small or enclosed spaces with means to evacuate particulates which did not adhere to the workpiece is shown. Hereafter, the term attachment or invention 5 will refer to the attachment for a spray device 10 for use in small or enclosed spaces with means to evacuate particulates.

The attachment 5 to the spray device 10 includes a hollow inverted L-shaped element 30 which is solid and does not bend. The top or shorter portion 40 of the hollow inverted L-shaped element 30 is integral with and generally perpendicular to the bottom or longer portion 50 of the hollow inverted L-shaped element 30.

The proximal end 74 of the upper elongated flexible tube 60 is attached to the front side 42 of the top or shorter portion 40 of the hollow inverted L-shaped element 30.

The distal end 72 of the upper elongated flexible tube 60 is removably attached to the to the back portion 72 of the spider 80. The spider 80 holds a nozzle 90 centrally in place at the distal end of the upper elongated flexible tube 60. The spider 80 is a removable support structure for the nozzle 90.

Interior of the elongated flexible tube 60 is an elongated flexible coaxial tube 100 which connects to the nozzle 90 on the distal end 72 and traverses the interior length of the elongated flexible tube 60 to and beyond the distal end 74 where it is in position to attach to the spray device spider 7610 at a mating coupling 110. The mating coupling 110 may be, but is not limited to, a threaded fastener, detent coupling, and the like. Further, the mating coupling 110 may be sized and toleranced to fit any commercially available spray device 10.

The hollow inverted L-shaped element 30 includes an upper portion 40 through which the flexible coaxial tube 100 passes through until it is mated to the spray device 10 by the mating coupling 110.

The hollow inverted L-shaped element 30 also includes a downward portion 50 which is generally perpendicular in a downward fashion to the upper portion of the hollow inverted L-shaped element 30. Depending from the bottom 52 of the downward portion 50 is a second elongated flexible tube 120. The second elongated flexible tube 120 is further connected to a vacuum generating device (not shown) as well as a filtration device or devices, including. but not limited to, a prefilter, a HEPA filter and a Carbon filter (not shown).

FIG. 2 shows the flexibility of the elongated flexible tube 60 and elongated flexible coaxial tube 100 (best seen in FIG. 5) which resides therein. The elongated flexible tube 60 with it's flexible coaxial tube 100 residing generally centrally inside is not limited to the upward flex as shown in FIG. 2. This portion of the attachment 5 can flex up, down, left, right and all of the angles there-between.

Figure 3:
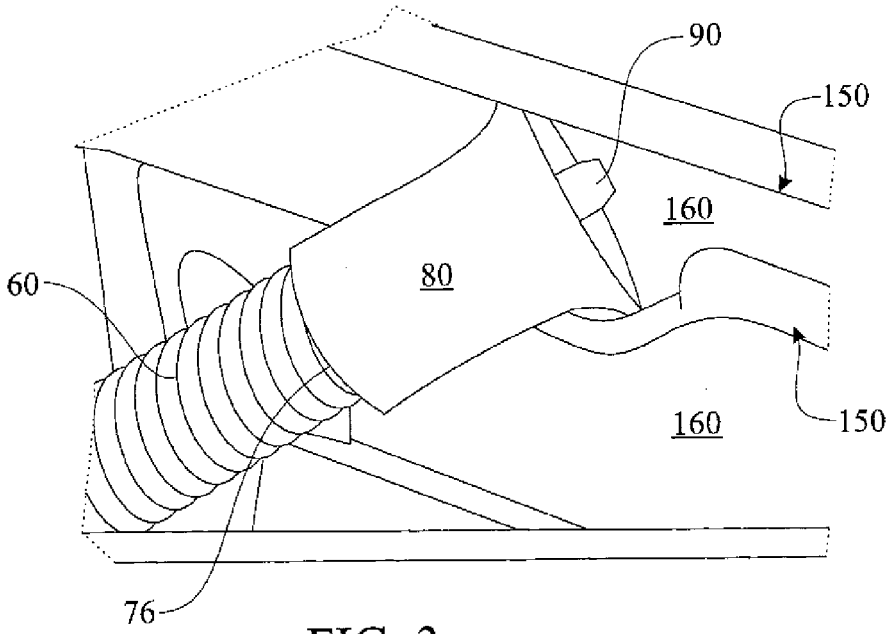
FIG. 3 is a partial view of the front portion of the invention accessing a small space to permit spraying therein.

Referring now to FIG. 3, the attachment 5 is shown accessing a hard to reach area on a workpiece 150. When the spray device 10 is activated, whatever coating is being employed travels down the elongated flexible coaxial tube 100 until it reaches the nozzle 90, where it is atomized and the atomized material spreads out into the hard to reach area on workpiece 150. Concurrently, a vacuum is created by the vacuum generating device (not shown) which creates a vacuum which action proceeds from the second elongated tube 120, through the hollow inverted L-shaped element 30, and further through the elongated flexible tube 60. At this point, the vacuum or negative air pressure would remove any overspray or errant particles which did not adhere to the workpiece 150, such as those that would be floating in internal cavities 160. This overspray and such would be caused to flow down the airway in the elongated flexible tube 60, down through the inverted L-shaped element 30, and into the second elongated tube 120. At this point the vacuum generating means (not shown) would pull the contaminated air through an appropriate filter and then once the air has been remediated exhaust it into the environment.

Figure 4:
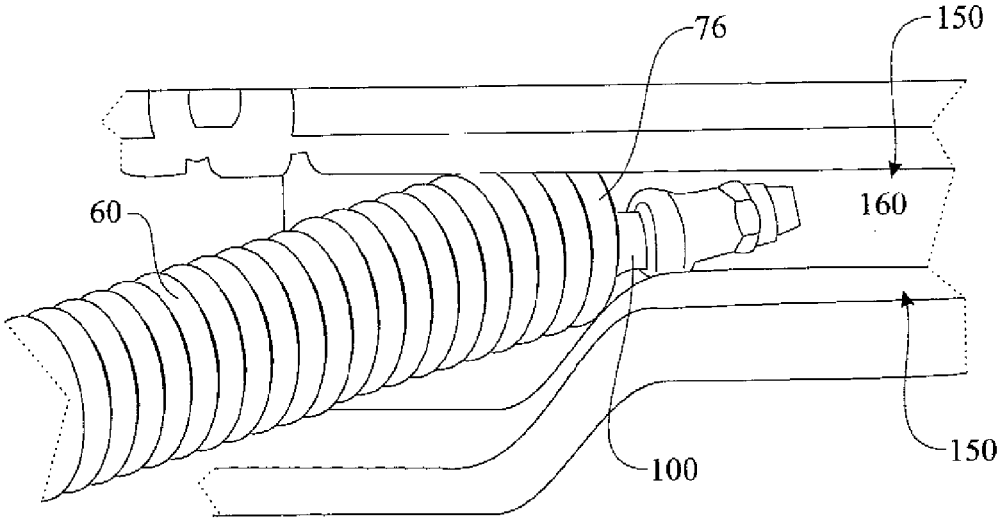
FIG. 4 is a partial view of the front portion of the invention, showing the spider removed and the vacuum hose retracted, with the nozzle accessing even a smaller space than shown in FIG. 4.

Referring to FIG. 4, the attachment 5 is required to access even a smaller and more difficult to access area. In order to allow this to happen, the spider 80 is removed and the elongated flexible tube is retracted back about the elongated flexible coaxial tube 100 which allows the nozzle 90, with its lesser diameter, to access a smaller and more difficult to access area.

As, before, when the spray device 10 is activated, whatever coating is being employed travels down the elongated flexible coaxial tube 100 until it reaches the nozzle 90 where it is atomized and the atomized material spreads out into the hard to reach area on workpiece 150. Concurrently, a vacuum is created by the vacuum generating device (not shown) which creates a vacuum which action proceeds from the second elongated tube 120, through the hollow inverted L-shaped element 30, and further through the elongated flexible tube 60. Despite the fact that the elongated flexible tube 60 is now a greater distance from the nozzle 90, a vacuum is still created in the smaller and more difficult to access area. Sufficient vacuum or negative air pressure would remove any overspray or errant particles which did not adhere to the workpiece 150, such as those that would be floating in internal cavities 160 even with the elongated flexible tube 60 in it's retracted position. This overspray and such would be caused to flow down the airway, past the nozzle 90, into the elongated flexible tube 60, down through the the inverted L-shaped element 30, and into the second elongated tube 120. At this point the vacuum generating means (not shown) would pull the contaminated air through an appropriate filter and then once the air has been remediated, exhaust it into the environment.

Figure 5:
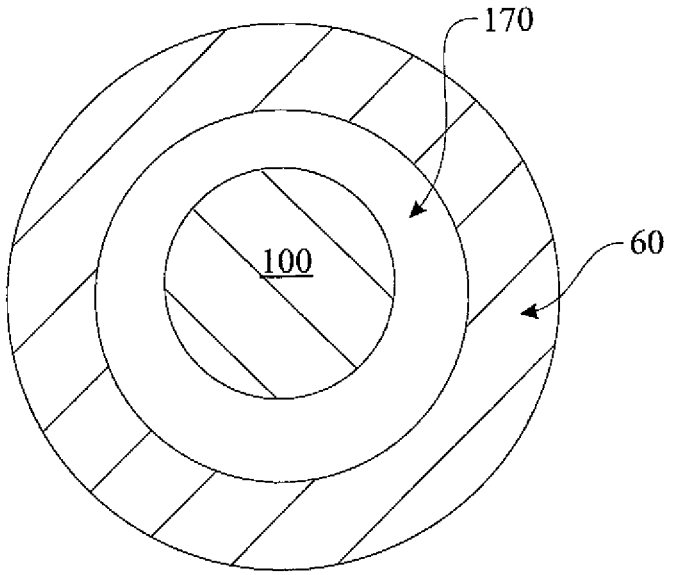
FIG. 5 is a view taken along the line 5-5 of FIG. 1, showing the tube attached to the nozzle interiorly located in the front hose of the invention.

Referring now to FIG. 5. a view taken along line 5-5 of FIG. 1 is shown.

This shows a cut away view of the upper elongated flexible tube 60 in relation to the flexible coaxial tube 100 residing centrally or co-axially inside of the upper elongated flexible tube 60. Between the upper elongated flexible tube 60 and the flexible coaxial tube 100 is a generally cylindrical airway 170. This airway 170 permits the vacuum to egress any particulates, overspray or errant particles which did not adhere to the workpiece 150.

Both the upper elongated flexible tube 60, the second downward elongated tube 120, and the inverted L-shaped or elbow element 30 should be cleaned to prevent fouling.

Figure 6:
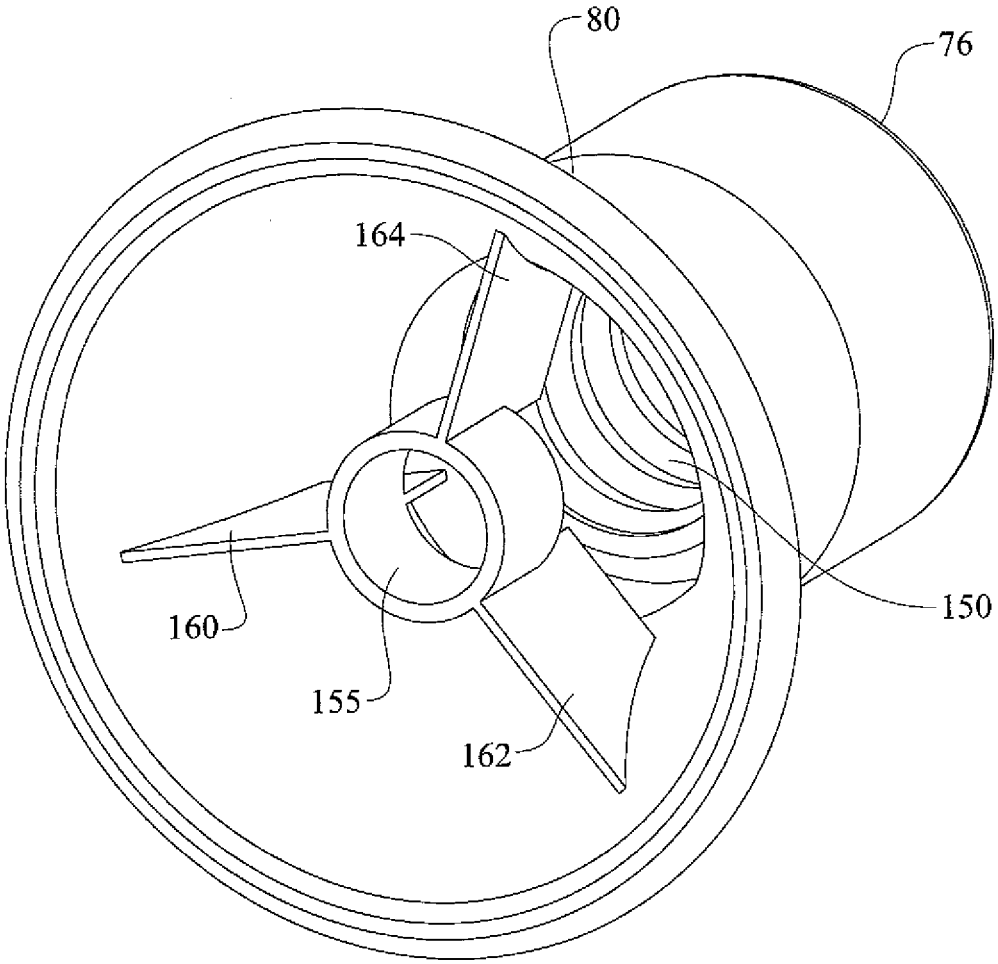
FIG. 6 is a view of the spider attached to the front hose of the invention sans nozzle.

Referring now specifically to FIG. 6, the spider 80 is shown removed from both the elongated flexible tube 60 and the elongated flexible coaxial tube 100 which terminates at nozzle 90. The spider 80 would be attached to the distal end of the elongated flexible tube 60 at about element 76. Element 150 is the interior sidewall of the rear portion of the spider 80 which is adapted to engage the elongated flexible tube 60. Cylindrical element 155 is centrally held by three support elements 160, 162, and 164. The cylindrical element 155 is adapted to receive the nozzle 90 therein, permitting stability of the nozzle 90 when spraying. It is to be understood that the spider 80 may assume other forms for specialized projects where access of a circular spider 80 may not fit. These forms include, but are not limited to, ellipses, squares and rectangles.

Figure 7:
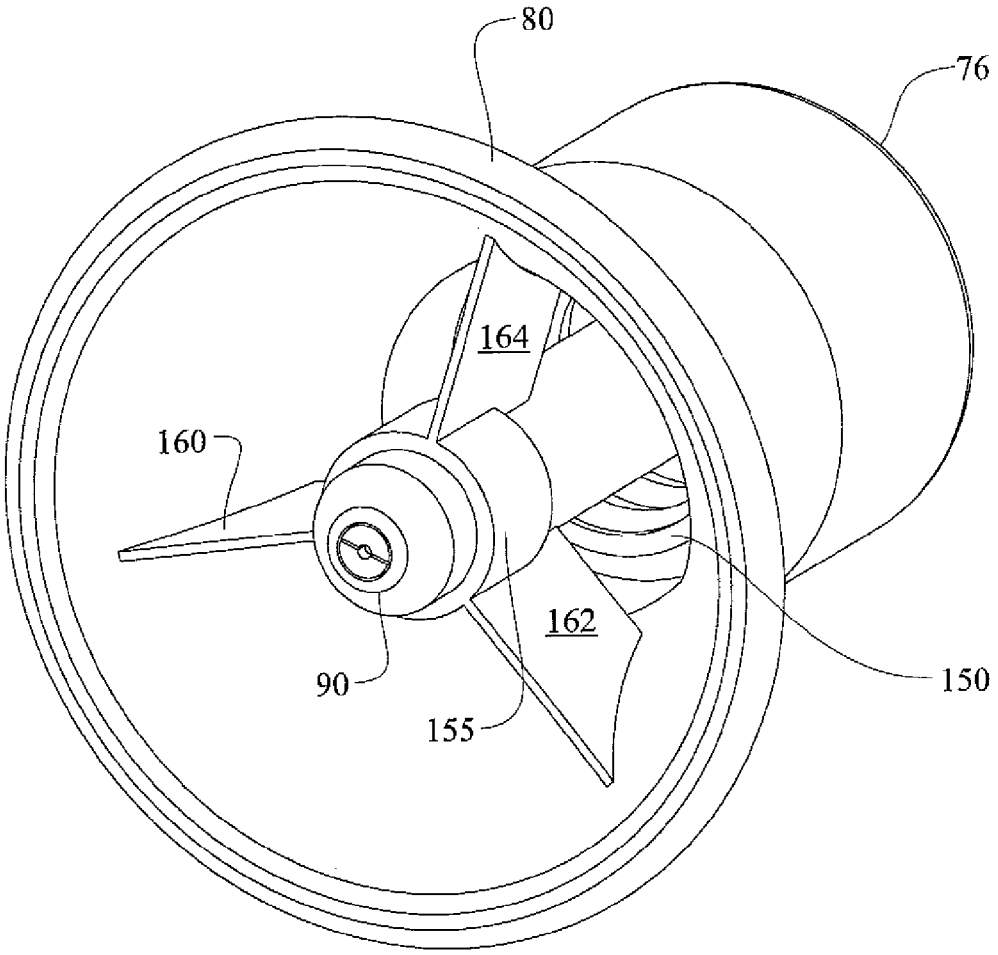
FIG. 7 is a view of the spider attached to the front hose of the invention showing the position of the nozzle when attached to the spider.

Referring now specifically to FIG. 7, the spider 80 is shown supporting the nozzle 90 in the cylindrical element 155. All other elements have been described in the discussion of FIG. 6.

Figure 8:
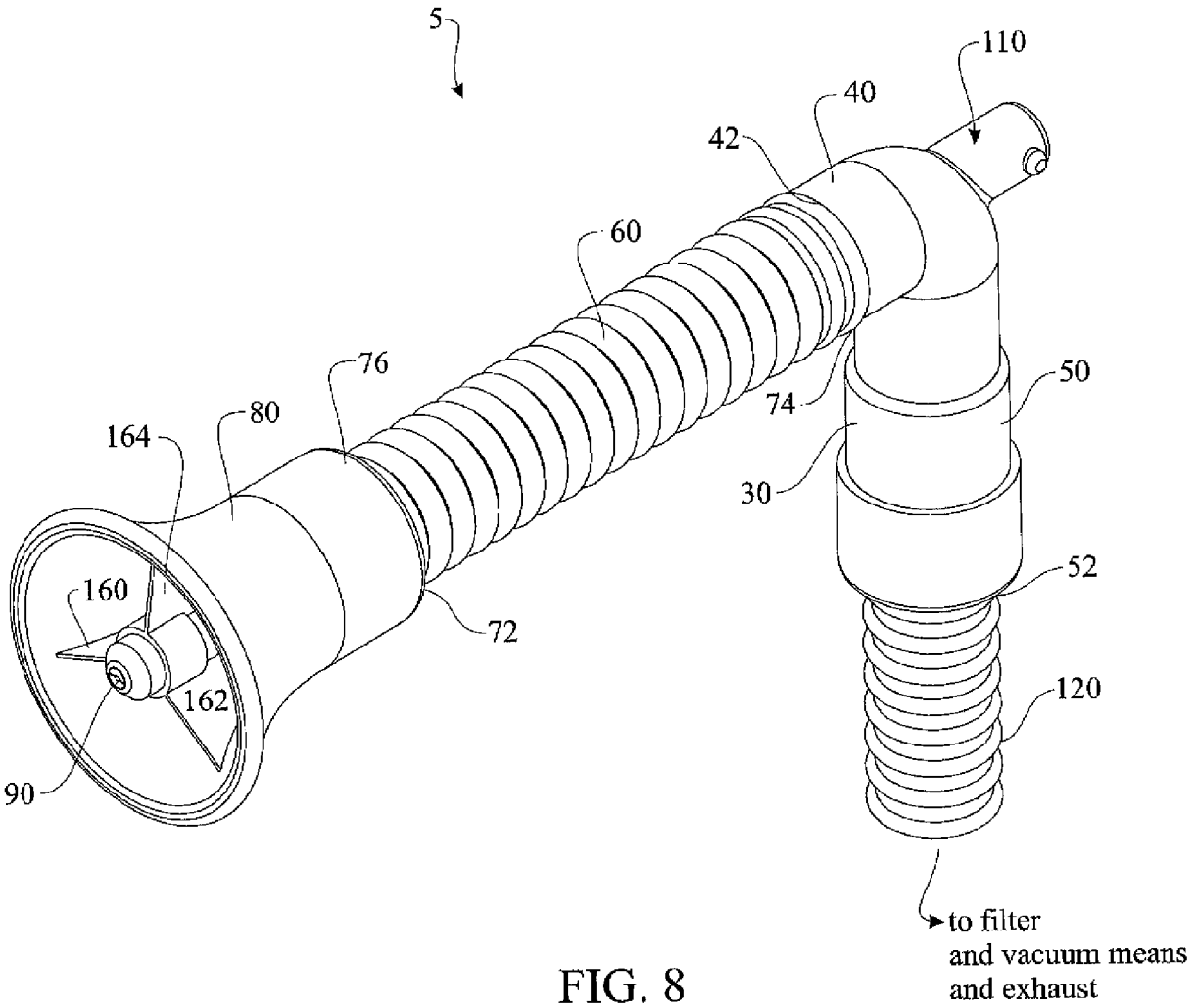
FIG. 8 is a perspective view of the Attachment to a Spraying Device.
Figure 9:
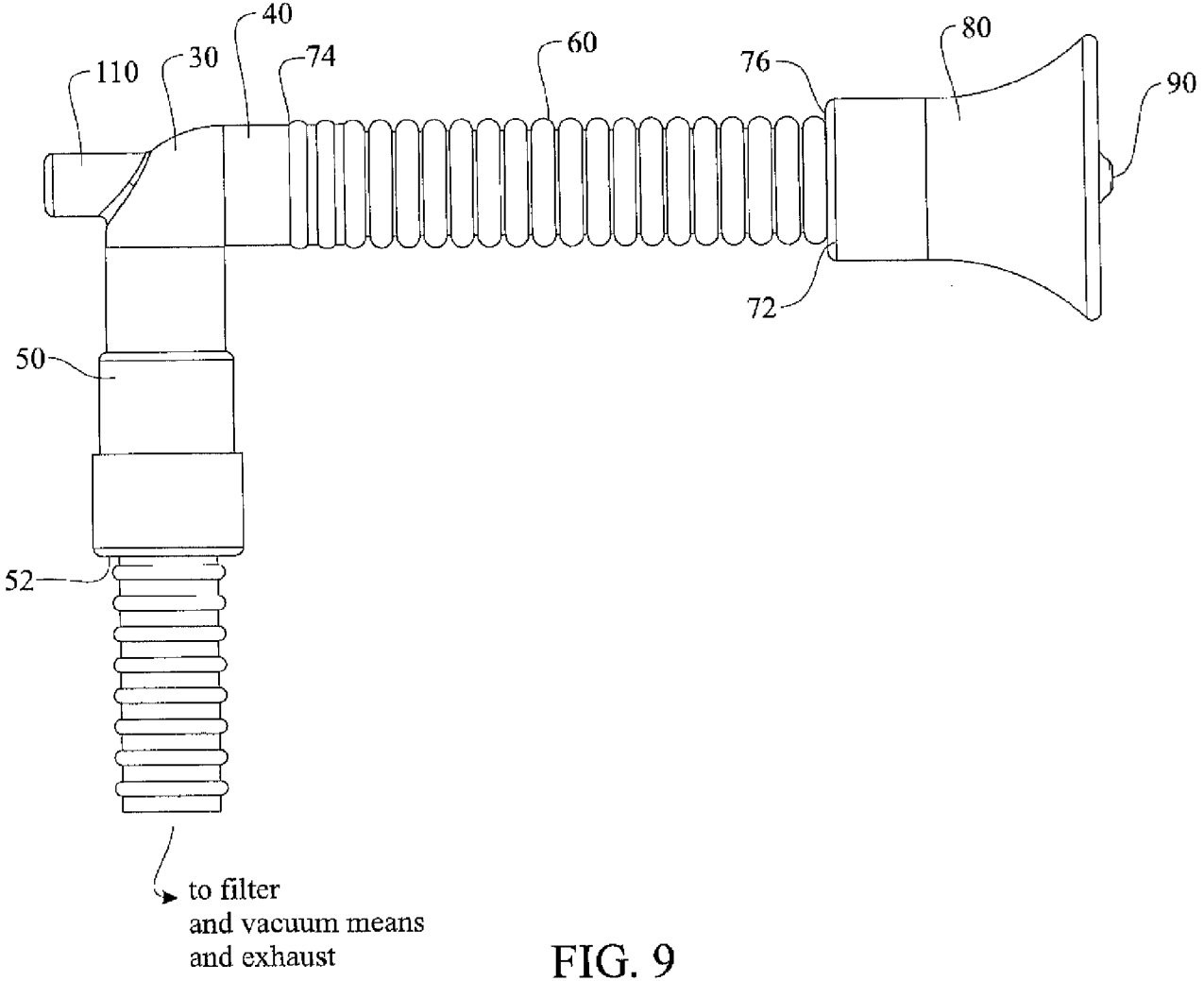
FIG. 9 is a side view of the Attachment to a Spraying Device.

Referring now to FIGS. 8 and 9, both a perspective view and a side view of the invention, an attachment 5 for a spraying device 10, which can access difficult to reach areas to spray or coat are show. Elongated flexible tube 60 with an interiorly disposed flexible coaxial tube 100 is shown in a straight position. It can however, be flexed to any angle as shown in FIG. 2. Additionally, the spider 80 is removable from the distal end 76 of elongated flexible tube 60 to permit the retraction of the distal end 76 of the flexible tube 80 about the nozzle 90 to access even more difficult to access regions to allow coating and removal of any particulates which did not adhere to the workpiece 150. In this case areas in which the nozzle diameter is less than the area of the space in which a workpiece is disposed can now be easily accessed to allow the introduction of material to coat or cover or place said material on the workpiece while concurrently having any have atomized material which is still present in the air after the material introduction removed and remediated. It is well known that such vapors, solvents, and chemicals in materials used in the spraying industry have hazardous health consequences and are flammable, especially if retained in a small confined workspace. The invention 5 mitigates these and other environmental concerns.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. An attachment for a spraying device to permit spraying an atomizable substance into hard to access areas to be coated by said atomizable substance comprising:

a coupling device having a first side, a second side and a bottom side, said bottom side perpendicular to said first side and said second side, said first side adapted to connect said attachment to a spraying device, a first elongated resilient hose having a first side and a second side, said first side of said first elongated resilient hose connected to said second side of said coupling device, said first elongated resilient hose having a second resilient hose disposed internally, said second resilient hose having a first side and a second side, said second resilient hose first side is connected to said spraying device allowing said atomizable substance which leaves said spraying device to flow down said second resilient hose, a nozzle connected to said second resilient hose said second side, and a removable nozzle support centrally supporting said nozzle inside said removable nozzle support, said removable nozzle support having a first side and a second side, said removable nozzle support said first side removably connected to said first elongated resilient hose said second side, a third elongated resilient hose having a first side and a second side, said third elongated resilient hose perpendicular to said first elongated resilient hose, and said third elongated resilient hose said first side connected to said coupling device bottom side, said coupling device including a downwardly oriented cylindrical member located intermediate said bottom side and said third elongated resilient hose said first side, said downwardly oriented cylindrical member is in communication with the interior of said first elongated resilient hose along its entire length including the area around said nozzle and about said nozzle support, and when said removable nozzle support is removed from said first elongated resilient hose said second side, said nozzle and a first portion of said second hose said second side are exposed, permitting said nozzle to access areas on the workpiece which would not be accessible with said removable nozzle support remaining attached to said first elongated resilient hose said second side, and when said attachment is attached to said spraying device and said spraying device is actuated, said third elongated resilient hose said second side is connected to a vacuum generator which establishes a vacuum in said third elongated resilient hose and an annular region intermediate said first elongated resilient hose and said second resilient hose, and simultaneously said nozzle at said second hose said second side discharges and atomizes said atomizable substance into the hard to access area, which creates overspray and the vacuum causes the overspray to be removed from the hard to access area, by traversing through said annular region intermediate said first elongated resilient hose and said second resilient hose, then passing through said coupling device said first side, and then further passing through said coupling device said bottom side, and then further passing into said third elongated resilient hose whereby the overspray is rendered harmless by a filter and then the remediated air is exhausted to the atmosphere.

2. An attachment for a spraying device to permit spraying an atomizable substance into hard to access areas to be coated by the atomizable substance as claimed in claim 1 wherein said second hose and said nozzle both have a diameter less than the diameter of elongated resilient hose.

3. An attachment for a spraying device to permit spraying an atomizable substance into hard to access areas to be coated by the atomizable substance as claimed in claim 2 wherein said first elongated resilient hose said second side is retractable back toward said first elongated resilient hose said first side, causing a second portion of said second hose said second side to become exposed, permitting said nozzle to access areas which would not be accessible without said retraction of said first elongated resilient hose.

4. An attachment for a spraying device to permit spraying an atomizable substance into hard to access areas to be coated by the atomizable substance as claimed in claim 3 wherein when said first elongated resilient hose is retracted a vacuum of sufficient strength to evacuate any overspray into said first elongated resilient hose said second side.

* * * * *